US005641064A

United States Patent [19]

Goserud

[11] Patent Number: 5,641,064

[45] Date of Patent: Jun. 24, 1997

[54] STORAGE CONTAINER HAVING CHANGEABLE IDENTIFYING INDICIA

[76] Inventor: J. Thomas Goserud, 3152 Woodridge Dr., Landisville, Pa. 17538

[21] Appl. No.: 580,611

[22] Filed: Dec. 29, 1995

[51] Int. Cl.[6] ..... B65D 85/58

[52] U.S. Cl. ..... 206/315.1; 206/445; 206/775

[58] Field of Search ..... 206/315.1, 579, 206/445, 775, 459.5, 0.81, 0.8, 0.815, 0.82, 0.83, 0.84; 215/247; 220/377.1

[56] References Cited

U.S. PATENT DOCUMENTS 4,382,508 5/1983 Robbins et al. ..... 206/315.1 X 5,060,812 10/1991 Ogle, II ..... 215/247

5,522,518 6/1996 Konrad et al. ..... 215/247

*Primary Examiner*—Jacob K. Ackun

*Attorney, Agent, or Firm*—Norman B. Rainer

[57] ABSTRACT

A storage container for a plurality of uniformly sized circular, elongated or spherical objects includes a transparent plastic tube of circular cylindrical shape terminating in opposed open parallel extremities of circular configuration. A closure cap removably engaging at least one extremity of the tube has a collar portion having a flange that defines a central aperture region whose diameter is smaller than the inside diameter of the tube. A plug member and a flat retainer disc may removably reside within the collar portion.

11 Claims, 2 Drawing Sheets

STORAGE CONTAINER HAVING CHANGEABLE IDENTIFYING INDICIA

BACKGROUND OF THE INVENTION

1. Field of the Invention

This invention concerns a tubular device for holding a plurality of similar objects.

2. Description of the Prior Art

A popular pastime for children is the collecting of discs known as "POGS"™. The POGS™ are flat circular discs having a standardized diameter of approximately 41 millimeters, and are generally fabricated of stiff cardboard or plastic. The thickness of each disc is about 1 millimeter, and at least one surface of the disc contains visibly distinctive indicia such as cartoon pictures.

The POGS™ are acquired by collectors either by purchase at stores or by winning in games played with other collectors. It is not unusual for a collector to have several hundred POGS™. It has been found convenient to store the POGS™ in stacked array within tubular containers having removable end cap closures and having a holding capacity of 25 to 200 POGS™. Most collectors prefer to group their POGS™ in a single container in accordance with some underlying theme, such as animal characters, flowers, fish, sports celebrities, motion picture celebrities, geographic scenes, historical depictions, etc. However, there has been no way of knowing the nature of the POGS™ within a container unless the collector places some sort of marking upon the exterior of the container. Also, none of the known containers suitable for POG™ storage interactively enhance the pastime.

Golf balls are often marketed in tubular packages containing several golf balls, the packaging permitting visual observation of the balls. It is desirable, however, to provide an option for personalized labeling of the packages. In situations where a message on the tubular packaging might obscure the balls it is desirable to have an open top to provide a clear view of the contents or additional copy space for easy-to-change messages within the tube. This is particularly important for tournament awards, where last minute names and winners can be placed within the case or on the ends of the case and appear as though they were always part of the award.

Tubular cylindrical containers for shipping and storage purposes are well known. Various types of closure caps for tubular containers are disclosed in U.S. Pat. Nos. 3,476,240; 3,749,277; 3,913,774; 3,986,659 and 5,052,578. None of the aforesaid closure means and their associated tubular containers, even if dimensioned to accommodate POGS™, are capable of displaying the contents of the container or providing interactive enhancement of the pastime. Some of the closure devices, although secure, are difficult to remove or replace.

Vertically elongated holders are well known for the desk top storage of pens and pencils in a ready-to-use manner. However, such devices usually are unsightly because of the random manner in which the pens and pencils are secured, and further lack versatility with respect to changeability of sidewall appearance, configuration of the opening, or the ability to add personalization.

It is accordingly an object of the present invention to provide a tubular container for storing and identifying a plurality of uniformly sized circular, spherical or elongated objects.

It is another object of this invention to enable the owner or vendor to associate an easily changed personal identification or special occasion message with the container of the foregoing object.

It is a further object of the present invention to provide a container of the aforesaid nature having one or two closure caps which are easily removed and re-installed.

It is a still further object of this invention to provide a container of the aforesaid nature having game-playing functionality.

These objects and other objects and advantages of the invention will be apparent from the following description.

SUMMARY OF THE INVENTION

The above and other beneficial objects and advantages are accomplished in accordance with the present invention by a storage container for a plurality of uniformly sized circular, elongated or spherical objects, said container comprising:

a) a transparent plastic tube of circular cylindrical interior and exterior contour elongated upon a center axis and terminating in opposed parallel extremities of circular configuration, and b) a closure cap of monolithic construction removably associated with at least one of said extremities, said cap comprising: 1) a collar portion bounded by a substantially circular cylindrical outer surface configured to make tight-fitting insertive frictional engagement with the interior of said tube, and an opposed substantially circular cylindrical inner surface concentric with said outer surface, and 2) a flange transversely disposed to said axis and defining a central aperture region whose diameter is smaller than the diameter of said inner surface, said flange having a perimeter directed outwardly from said axis and extending beyond said outer surface.

In a preferred embodiment, a resilient plug member is secured by said inner surface, and the outwardly directed perimeter of said flange has a polygonal shape having between 5 and 8 sides. A removable sleeve member may be disposed within said tube in resilient abutment with the interior surface of the tube. The sleeve preferably has visibly distinct characteristics which may provide decoration, message indicia or information relative to a game involving POGS™.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
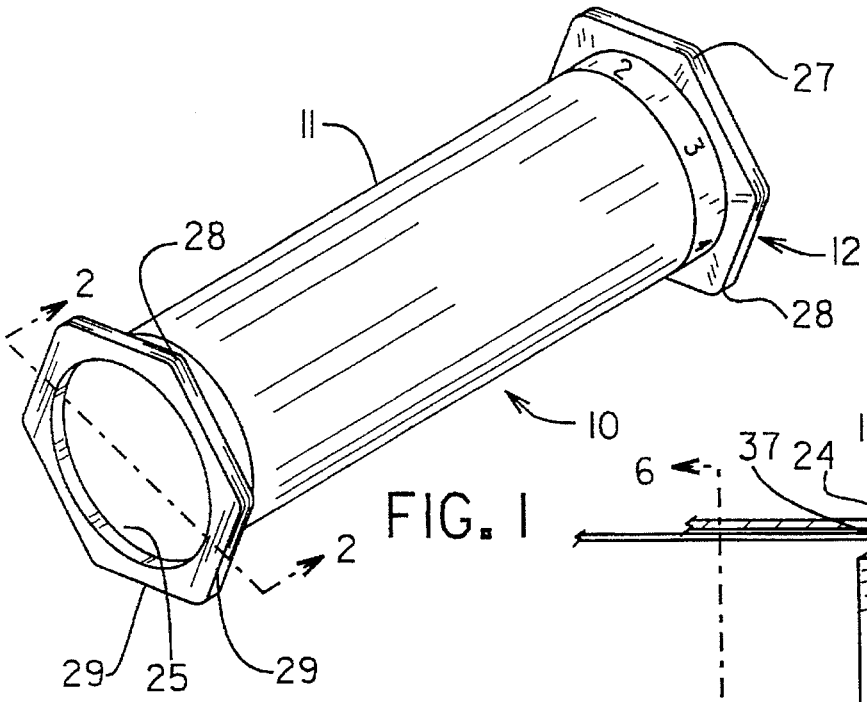
FIG. 1 is a perspective view of an embodiment of the container of the present invention.
Figure 2:
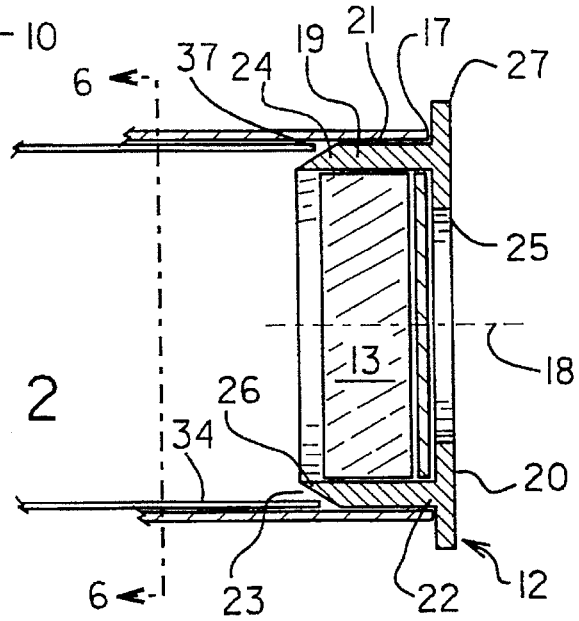
FIG. 2 is a fragmentary sectional view taken upon the line 2—2 of FIG. 1.
Figure 3:
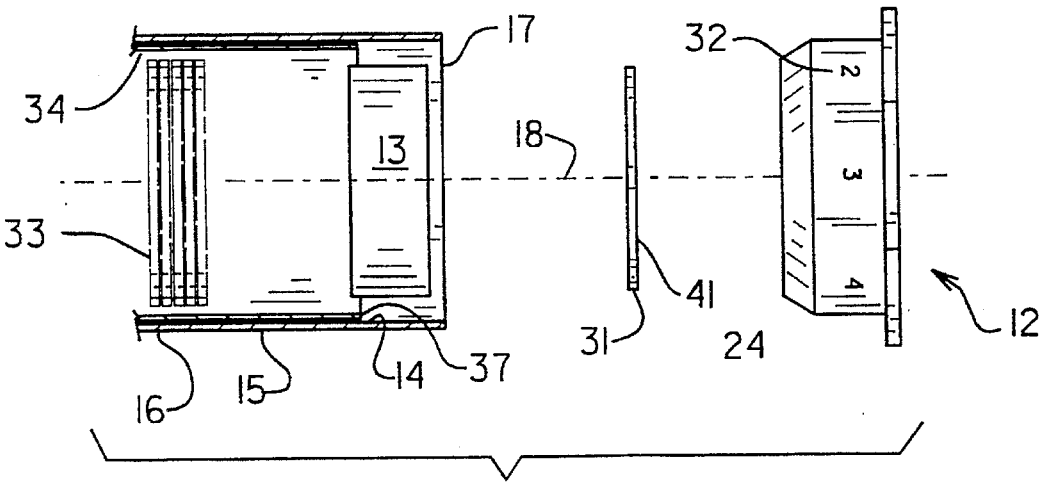
FIG. 3 is a fragmentary exploded view of the embodiment of FIG. 1.

Referring to FIGS. 1–3, an embodiment of the storage container 10 of the present invention is shown comprised of cylindrical tube 11 equipped with paired closure caps 12 and optional removable plug members 13 secured by said closure caps.

Tube 11 is fabricated preferably of a transparent plastic having good resistance to breakage by way of impact. The thickness of the wall 16 of the tube, measured orthogonally between interior surface 14 and exterior surface 15, is within the range of about 0.5 mm. to 1.5 mm. Wall 16 is preferably resilient as a consequence of its small thickness and suitable choice of polymer. Representative polymers useful in the fabrication of the cylinder are polyester and nitrile-based polymers and copolymers such as those currently employed in the production of disposable soft drink bottles. Tube 11 terminates in opposed open extremities 17 of circular contour disposed in parallel planes perpendicular to the center axis of elongation 18 of said tube.

Each closure cap 12, removably associated with an extremity of tube 11, is a monolithic structure fabricated of plastic and comprised of a collar portion 19 and flange portion 20. Collar portion 19 extends between proximal and distal extremities 22 and 23, respectively, and is further defined by circular cylindrical outer surface 21 configured to make tight-fitting insertive frictional engagement within tube 11, and opposed inner surface 26 of substantially circular cylindrical contour in concentric relationship with said outer surface. Distal extremity 23 of said collar portion has a chamfered circular edge 24 to facilitate insertion into tube 11. Said chamfered edge may have a rounded or conical configuration which tapers toward axis 18 in the direction away from flange portion 20.

Figure 5:
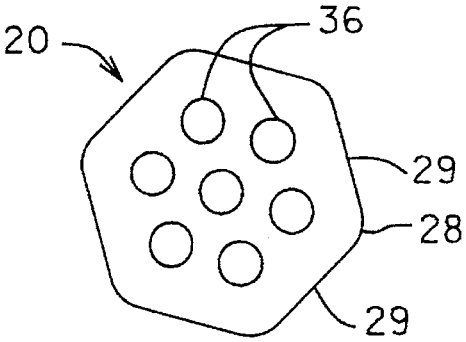
FIG. 5 is an end view of an alternative embodiment of the container of this invention.

Flange portion 20 is located at the proximal extremity of said collar portion, and is orthogonally disposed to axis 18 and the inner and outer surfaces of the collar portion. Flange portion 20 has an interior perimeter that defines central aperture region 25 having a diameter smaller than the diameter of inner surface 26 of collar portion 19. An outwardly directed perimeter 27 of flange portion 20 extends beyond outer surface 21, and may have a circular shape or a polygonal configuration wherein the apices 28 between adjacent flat segments 29 are rounded. Although aperture region 25 preferably defines a single circular aperture, multiple apertures 36 may be disposed within said region, as shown in FIG. 5.

A resilient puck-shaped plug member 13 is configured for emplacement within inner surface 26, preferably by frictional engagement therewith, in a manner so as to press a flat retainer disc 31, which may be a POG™, into abutment against flange portion 20. In alternative embodiments, the plug member may be of non-puck configuration, and may engage inner surface 26 by threaded or snap in place features. Because the diameter of disc 31 is slightly larger than the diameter of aperture 25, the disc is retained by flange 20 while being substantially entirely visible exteriorly of the storage container. By virtue of such construction of the closure cap, aperture 25 serves as a window which enables a selected POG™ to be exhibited. The remaining POGS™ 33 will usually fill the cylinder in stacked array. Disc 31 has two display surfaces 41, either of which can be directed outwardly, and both surfaces adapted to hold printed or other visibly distinctive indicia. Disc 31 may alternatively be transparent.

Figure 8:
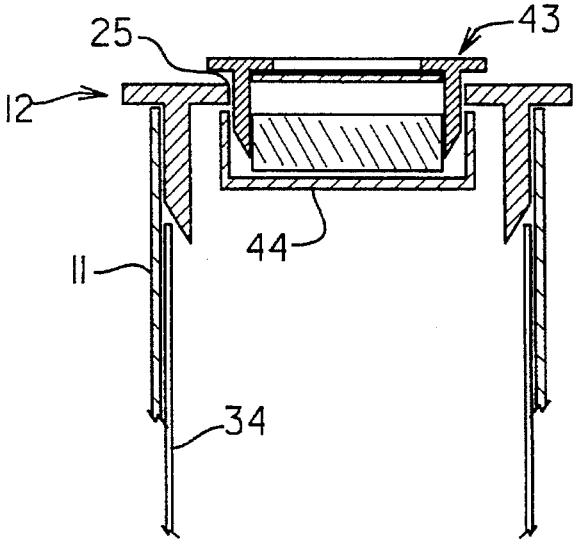
FIG. 8 is a fragmentary sectional view of a second alternative embodiment.

In another embodiment of the container, auxiliary smaller cap 43 of similar construction to cap 12, may be removably inserted into aperture region 25, as shown in FIG. 8. Smaller cap 43 is frictionally secured by cap 12, and serves to diminish the effective diameter of aperture region 25. A surrounding bushing 44 which may be interposed between the collar portions of the two caps allows for extra support to the plug 13. This embodiment further permits one container, having small caps, to be stored within a tube of larger diameter, provided bushing 44 is not in place.

The preferred polygonal configuration of the outwardly directed perimeter of flange portion 20 is of special importance because it has been found that, when the flat segments 29 of both caps are aligned, the container can be rolled upon a flat surface so as to come to rest by chance on a particular flat segment. Accordingly, the container serves as a gaming device, especially when distinguishing indicia such as numerals 32 are associated with each flat segment. In utilizing the container as a gaming device, two players may exchange their POGS™ in accordance with the rules of the game. When employed for such gaming purposes, it has been found that the polygonal shape of the perimeter of the flange should have between 5 and 8 flat segments 29. If the number of segments is less than 5, satisfactory rolling motion of the container is not achievable. With 5 or 6 segments, the apices between segments are preferably rounded to facilitate rolling motion. With 7 or 8 flat segments, satisfactory rolling motion can be achieved without said rounded apices. In a still further aspect of the gaming use of the container, one of the closure caps may contain indicia relating to rules of a game, while the opposite closure cap merely has numerical indicia. Therefore, when the rolled container comes to rest, the upwardly facing flat segment of one cap will show a numerical value while the opposite cap will indicate a certain circumstance or procedure of the game.

Figure 6:
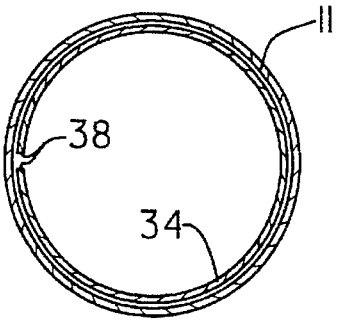
FIG. 6 is a sectional view taken in the direction of the arrows upon the line 6—6 of FIG. 2.

A sleeve 34 may be employed within the container in tight fitting engagement with interior surface 14 of tube 11. In one embodiment, the sleeve is a thin resilient plastic sheet of rectangular periphery having a size such that, when rolled and inserted into the cylinder, the rolled extremities 37 of the sleeve reside in abutment with the chamfered edges 24 of caps 12. Said sleeve may provide a decorative effect or message-displaying function and may further provide information relative to a game playable by the aforesaid technique of rolling the container. The sleeve may further provide special functionality when removed either partially or totally from the cylinder. For example, the sleeve may be deployable as a funnel which facilitates the entrance of thrown POGS™ into the container. The axially directed edges 38 of the sleeve are preferably in abutment. This causes the sleeve to be flexed tightly against interior surface 14, as shown in FIG. 6. A particularly preferred sleeve will have cut-out or transparent regions which permit observation of the contents of the container.

Figure 4:
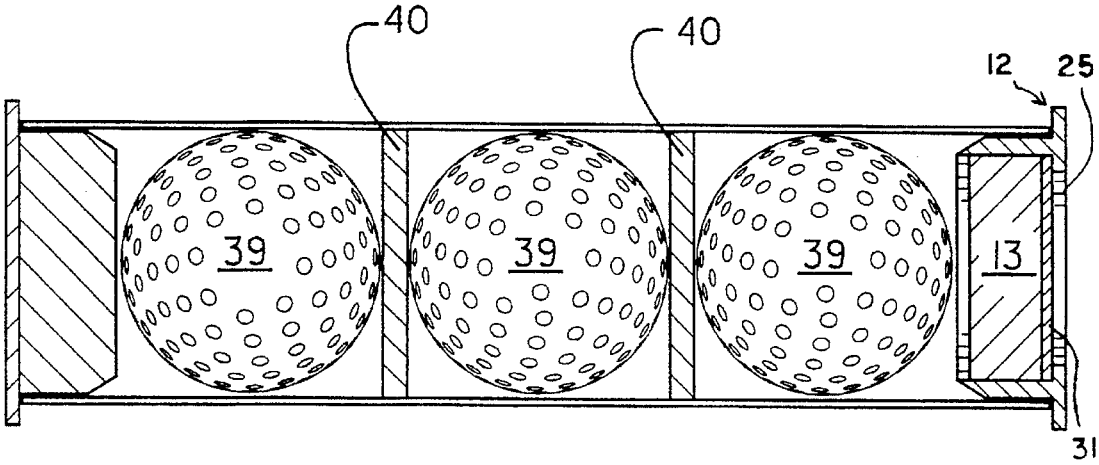
FIG. 4 is a side view of the container of FIG. 1, partly in section, shown holding golf balls.
Figure 7:
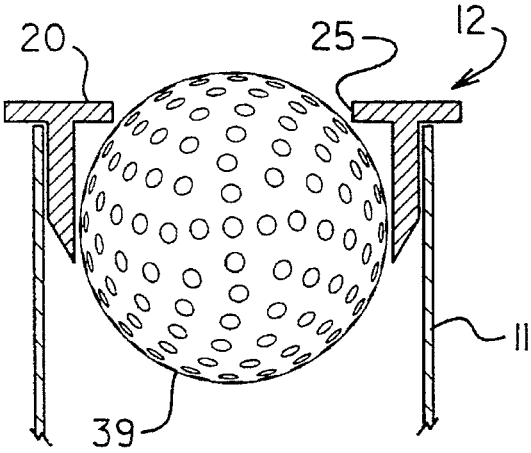
FIG. 7 is a fragmentary sectional view of a first alternative embodiment of the container.

In the embodiments of FIGS. 4 and 7, the container is shown to house golf balls 39 instead of POGS™. Spacers 40 may be optionally disposed between the golf balls. The discs 31 may display on their exteriorly directed surface 41 a verbal or pictorial message concerning a special occasion, product description, special event, or entertaining slogan. Because the discs are easily interchangeable, many different messages or other visual indicia may be associated with the container. In the embodiment of FIG. 7, disc 31 and plug 13 are absent, thereby enabling the golf ball to enter aperture 25.

The container embodiment of FIG. 5, when standing upright upon one closure cap serves as a pencil holder when the disc 31 and plug member 13 are removed from the uppermost, multi-apertured closure cap. It is to be further noted that, in other uses, the multi-apertured cap may be interactive with indicia on the associated disc.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A storage container for a plurality of uniformly sized circular, elongated or spherical objects, said container comprising:

a) a transparent plastic tube of circular cylindrical shape elongated upon a center axis, bounded by interior and exterior surfaces, and terminating in opposed open parallel extremities of circular configuration, b) a closure cap of monolithic construction removably associated with at least one of said extremities, said cap comprising: 1) a collar portion bounded by proximal and distal extremities, a substantially circular cylindrical outer surface configured to make tight-fitting insertive frictional engagement with the interior surface of said tube, and an opposed substantially circular cylindrical inner surface concentric with said outer surface, said distal extremity having a chamfered circular edge which facilitates insertion of said collar portion into said tube, and 2) a flange transversely disposed to said axis at said proximal extremity and defining a central aperture whose diameter is smaller than the diameter of said inner surface, said flange having a perimeter directed outwardly from said axis and extending beyond said outer surface, and c) a plug member of resilient, puck-shaped configuration removably retained by the inner surface of said collar portion.

2. The container of claim 1 wherein said tube is comprised of a wall having a thickness between about 0.5 mm. and 1.5 mm.

3. The container of claim 1 wherein the perimeter of said flange has a polygonal configuration.

4. The container of claim 1 wherein said plug member is frictionally retained by said inner surface.

5. The container of claim 1 further comprising a flat retainer disc disposed within said collar portion and held in abutting relationship between said plug member and flange.

6. The container of claim 1 further comprising a sleeve of thin plastic sheet material removably disposed within said tube in a rolled and flexed state so as to lie in tight fitting engagement with the interior surface of said tube.

7. The container of claim 6 wherein said sleeve, prior to rolling and flexing for disposal within said tube, has a periphery of rectangular configuration.

8. The container of claim 1 wherein said central aperture is comprised of a single aperture of circular contour centered upon said axis.

9. The container of claim 8 further comprising an auxiliary cap of small size removably inserted into said single aperture.

10. The container of claim 5 wherein said retainer disc has printed indicia thereupon.

11. The container of claim 6 wherein said sleeve has printed indicia thereupon.

* * * * *